US005160351A

United States Patent [19]

Schmidt et al.

[11] Patent Number: 5,160,351

[45] Date of Patent: Nov. 3, 1992

[54] PROCESS OF AND APPARATUS FOR CLEANING A DEDUSTING ELECTROSTATIC PRECIPITATOR

[75] Inventors: Hermann Schmidt, Bad Vilbel; Wilhelm Leussler, Frankfurt am Main, both of Fed. Rep. of Germany

[73] Assignee: Metallgesellschaft Aktiengesellschaft, Frankfurt/Main, Fed. Rep. of Germany

[21] Appl. No.: 705,335

[22] Filed: May 24, 1991

[30] Foreign Application Priority Data

Jun. 9, 1990 [DE] Fed. Rep. of Germany ..... 4018487

[51] Int. Cl.[5] ..... B03C 3/76; B03C 3/80

[52] U.S. Cl. ..... 55/12; 55/13; 55/110; 55/112; 55/121

[58] Field of Search ..... 55/12, 13, 112, 114, 55/117, 120, 121, 110, 5, 107, 10, 118

[56] References Cited

U.S. PATENT DOCUMENTS

| | | | |
|---|---|---|---|
| 1,766,422 | 6/1930 | Wintermute et al. | 55/12 |
| 1,937,265 | 11/1933 | Crowder | 55/118 |
| 2,874,802 | 2/1959 | Gustafsson et al. | 55/10 |
| 3,404,513 | 10/1968 | Roberts | 55/107 |
| 3,785,118 | 1/1974 | Robertson | 55/13 X |
| 4,178,156 | 12/1979 | Tashiro et al. | 55/13 X |

FOREIGN PATENT DOCUMENTS

| | | | |
|---|---|---|---|
| 861382 | 1/1953 | Fed. Rep. of Germany . | |
| 14851 | 9/1956 | Fed. Rep. of Germany | 55/118 |
| 2148902 | 5/1972 | Fed. Rep. of Germany | 55/10 |

*Primary Examiner*—Richard L. Chiesa
*Attorney, Agent, or Firm*—Michael J. Striker

[57] ABSTRACT

The process for cleaning collecting surfaces of dedusting electrostatic precipitators includes the steps of introducing a coarse-grained cleaning dust into the dedusting electrostatic precipitator, collecting at least the cleaning dust electrostatically in the dedusting electrostatic precipitator and periodically removing the cleaning dust so collected from the collecting surfaces to form a collected dust. To provide a more complete cleaning, the cleaning dust is fed into a gas-flowless space above the fields containing the collecting electrodes and the cleaning dust is distributed in the gas-flowless space according to the cleaning requirements. An apparatus for performing the above cleaning process is also described.

16 Claims, 4 Drawing Sheets

1
2
2
8
3
9
10
4
5
6
7

1
2
2
2
13
3
3
8
4
5
6
12

PROCESS OF AND APPARATUS FOR CLEANING A DEDUSTING ELECTROSTATIC PRECIPITATOR

Background of the Invention

This invention relates to a process of cleaning the collecting surfaces of a dedusting electrostatic precipitator and an apparatus for performing that process.

A process of this type is known, in which coarse-grained cleaning dust is introduced into the deduster and the cleaning dust alone or together with the dust contained in the raw gas is electrostatically collected in the deduster.

In a process of this type described in German Patent 861,382, it has been found that the surfaces of the collecting electrodes become covered with a layer of firmly adhering, fine dust, which cannot be removed by conventional cleaning methods. This requires shutdowns for mechanical cleaning, if a decrease of the separation rate to uneconomically low values is to be avoided. That problem was solved by feeding coarse-grained cleaning dust, which is collected on the collecting electrodes and which, as it is detached, will detach by an abrasive action also the fine dust, which otherwise cannot be detached. As a result, the effectiveness of the collecting electrodes is preserved.

SUMMARY OF THE INVENTION

According to the invention, cleaning dust is fed into a gas-flowless space above the fields of the dedusting electrostatic precipitator and is distributed in the gas-flowless space according to the cleaning requirements.

In the conventional process, it was not possible to introduce the cleaning dust so that all regions of the surfaces of the collecting electrodes are supplied with cleaning dust. The fine dust adhered to progressively increasing areas of the collecting electrodes and the separation rate was correspondingly decreased. Because the preferentially used dedusters, through which gas passes horizontally, have a substantial free space above the fields, i.e. above the gas flow region, (the gas-flowless space) it is possible to use that free space according to the invention for feeding the cleaning dust in controlled directions and at a controlled rate without other structural alterations of the deduster. This free space has been previously required to accommodate means for supporting and suspending corona electrodes and collecting electrodes, but is only partially occupied.

BRIEF DESCRIPTION OF THE DRAWING

An illustrative embodiment of the invention is shown in FIGS. 1 to 5.

DETAILED DESCRIPTION OF THE PREFERRED EMBODIMENT

Figure 1:
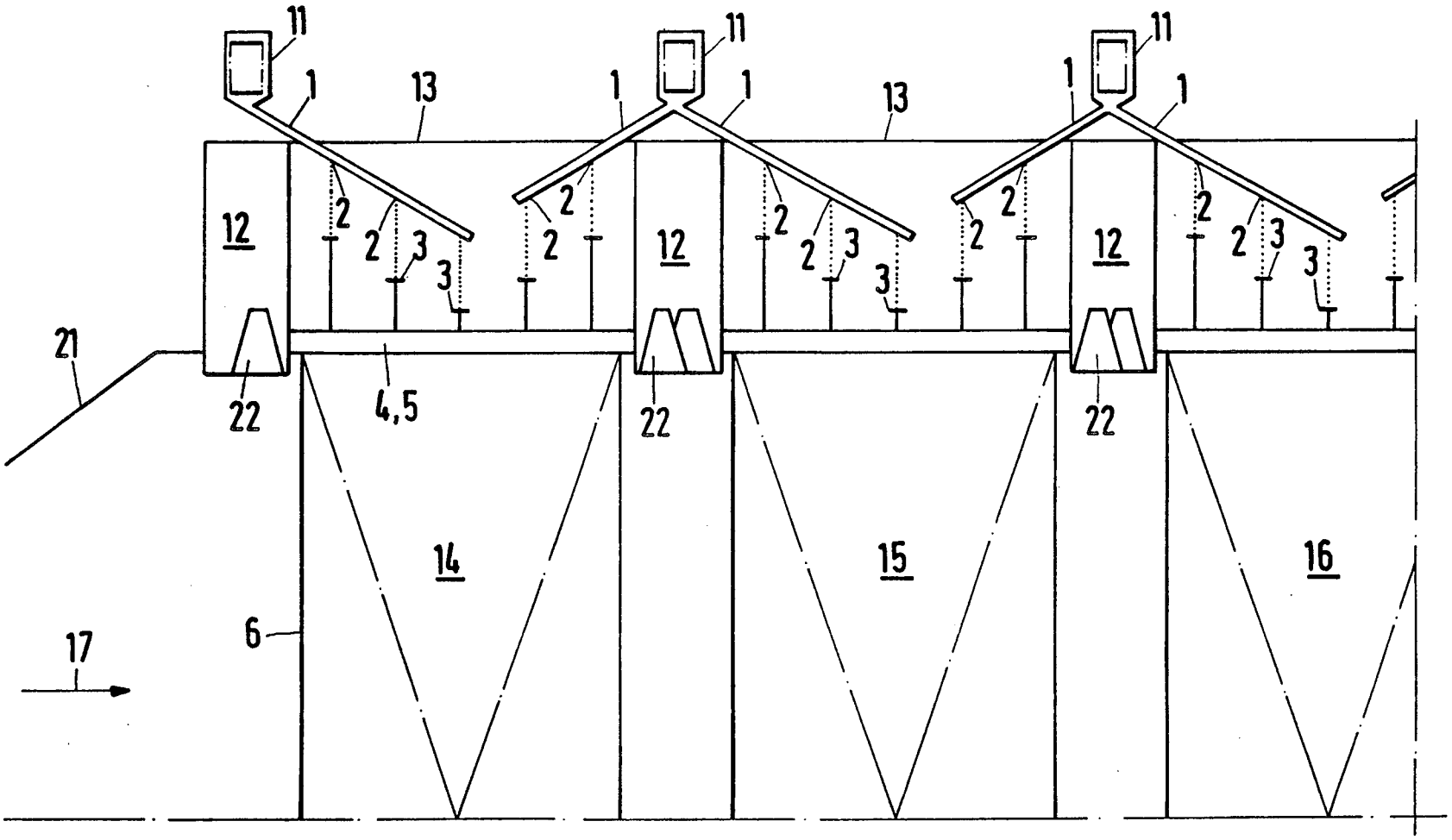
FIG. 1 is a longitudinal sectional view showing the upper portion of a deduster.

FIG. 1 shows portions of three separating fields 14 to 16, which are consecutively arranged in the direction of flow 17 of the gas and arranged in a housing, which is provided with tubular inlet ports 21, a top 13 and box-like roof supports 12, which extend transversely to the direction of flow 17 of the gas. The separating fields 14 to 16 substantially consist of platelike collecting electrodes 6, which extend parallel to the gas stream and are suspended from electrode supports 5, and of taut corona electrode wires, which are fixed to and extend in frames (not shown). The frames for the corona electrodes are supported in the roof supports 12 by insulators 22. Distributing means 11 extending transversely to the gas stream are disposed outside the housing and deliver cleaning dust to distributing pipes 1, which extend in a downwardly inclined direction through the top 13 of the deduster. The cleaning dust leaves the distributing pipes 1 through bottom outlet openings 2 and falls first onto baffle disks 3 and subsequently falls further into the separating fields 14 to 16.

Figure 2:
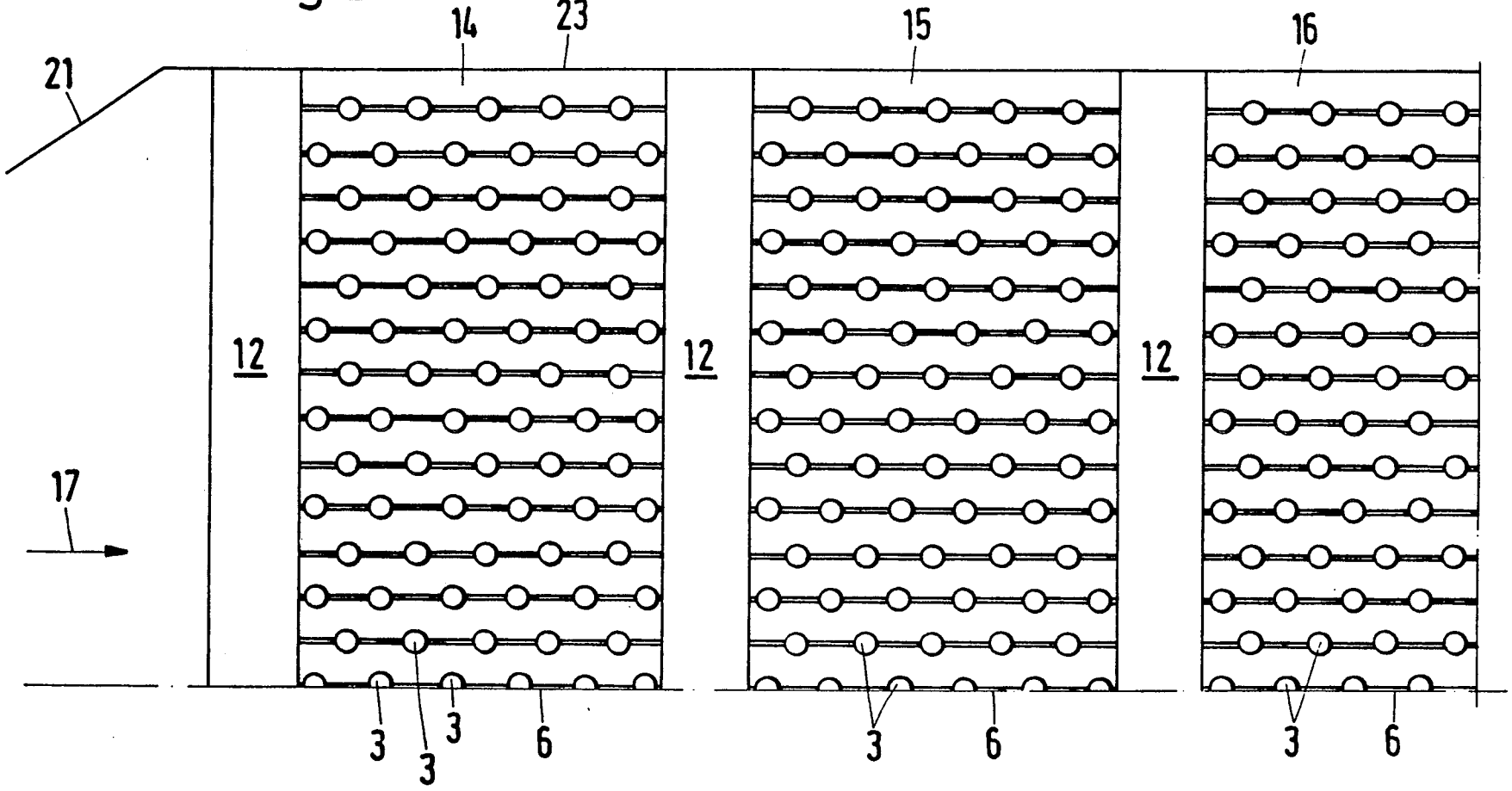
FIG. 2 is a horizontal sectional view taken on a line above the baffle plates and showing the deduster.

From the horizontal sectional view shown in FIG. 2 it is apparent how the baffle disks 3 are disposed above the collecting electrodes 6 in the fields 14 to 16. The roof supports 12, the direction of flow 17 of the gas, the tubular inlet port 21 and the side wall 23 of the deduster housing are also indicated.

Figure 4:
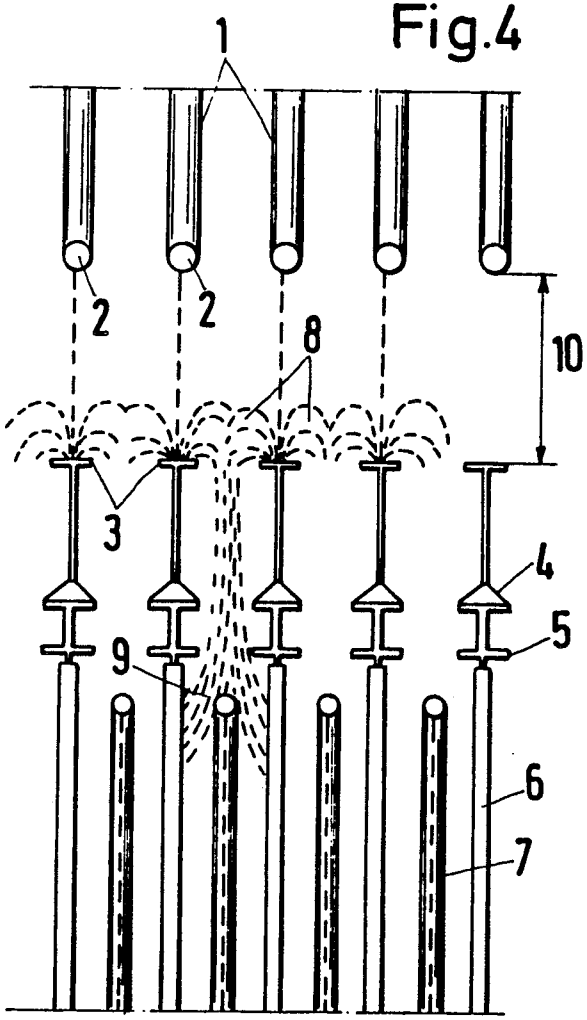
FIGS. 3 and 4, respectively are longitudinal and transverse vertical sectional views illustrating the trajectories of the cleaning dust.
Figure 3:
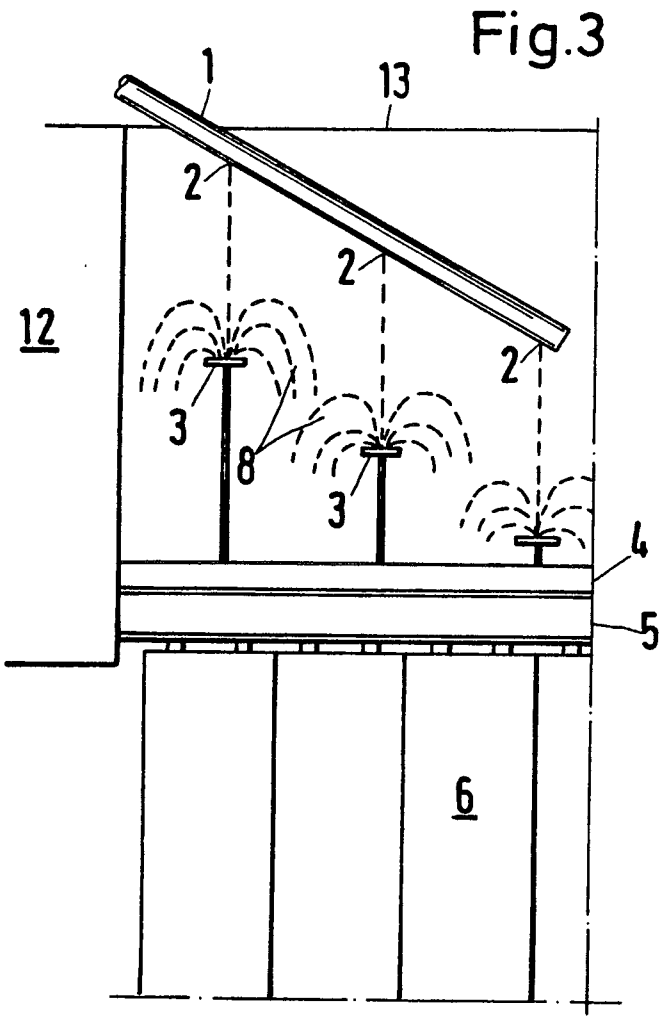

The partly sectional views of FIGS. 3 and 4 indicated how the cleaning dust falls through the outlet openings 2 of the distributing pipes 1 over the height of fall 10 onto the baffle disks 3 and rebounds from them and falls further down along the trajectories indicated at 8 and 9. Only the acceleration due to gravity 8 is initially effective and subsequently also the force of attraction 9 of the electrostatic field. The electrode supports 5 for the collecting electrodes 6 carry also the baffle disks 3 and have rooflike deflectors 4. They are secured at their ends to the roof supports 12. The frames 7 for the corona electrodes are also indicated in FIG. 4 between the collecting electrodes 6.

Figure 5:
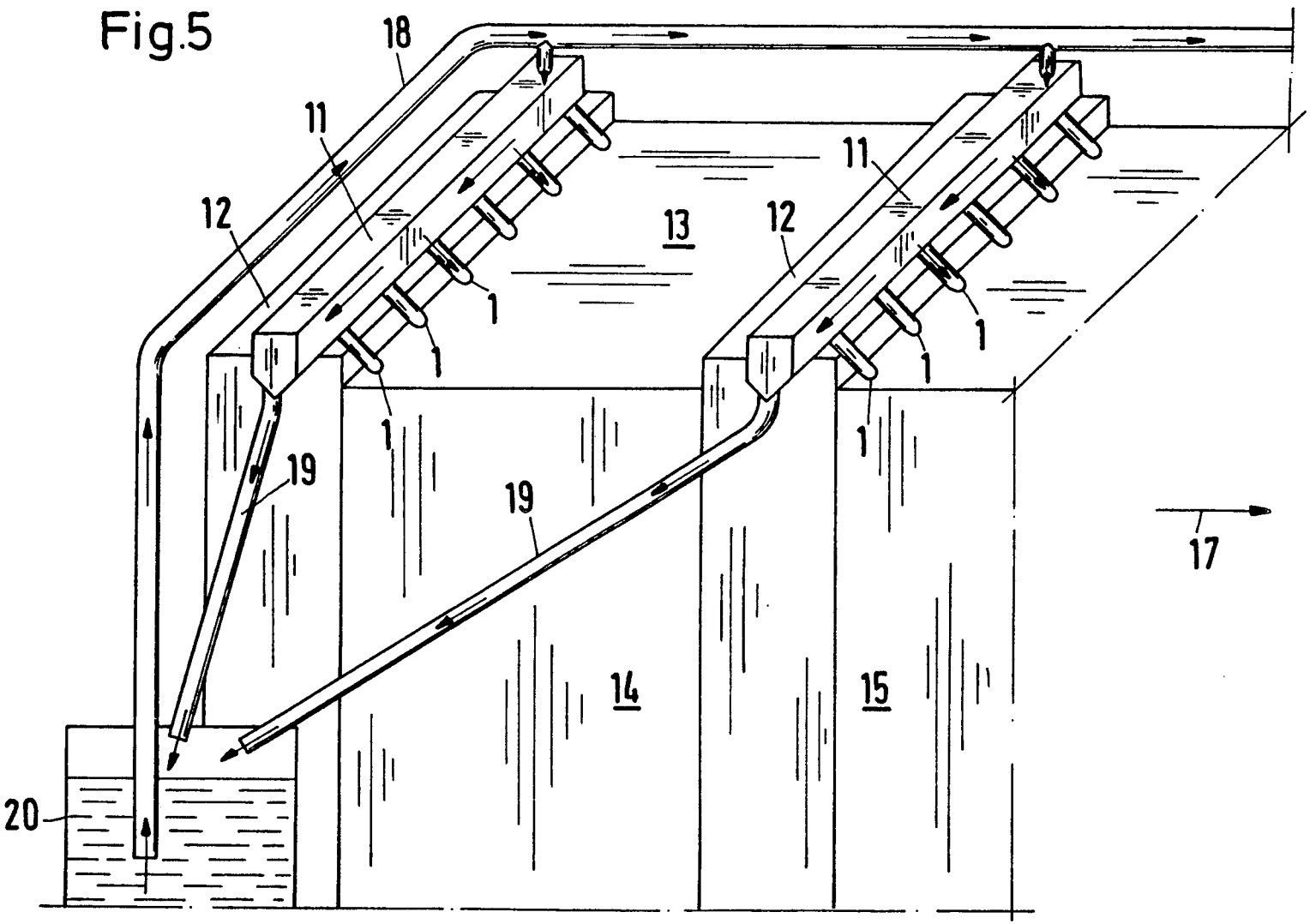
FIG. 5 is a perspective view showing a part of the feeding and distributing means.

The highly simplified perspective view in FIG. 5 illustrates mainly the feeding and distributing system. The distributing means 11 disposed above the roof supports 12 are supplied with cleaning dust from the (mechanical or pneumatic) dust feeding system 18. From the distributing means (11) consisting, e.g., of a troughed chain conveyor or a screw conveyor, the cleaning dust flows into the distributing pipes and through the top of the deduster into the deduster, the fields 14 and 15 of which are indicated, which are consecutively arranged in the direction of flow 17 of the gas. Surplus cleaning dust flows through a recycling system 19 into a separate dust collecting bin 20 and is fed from the latter by the feeder 18 into the deduster.

Experiments have shown that the application of the invention permits the collecting electrode surfaces to be kept clean by cleaning dust without difficulty, even in large dedusters with horizontal flow. The distribution and metering of the cleaning dust can be adapted to all requirements occurring in practice.

Where a cleaning dust such as quartz sand is employed which has a high dust resistivity, the cleaning dust is forced against the collecting electrodes by the forces produced by the electric field. If cleaning dust is supplied at a high rate, it has been observed that the cleaning dust flows downwardly in gushes like water. In response to a turning off or decrease of the high voltage, the cleaning dust detachs from the collecting electrode and falls down freely. As the high voltage is turned on or increased the field forces suddenly pull the cleaning back collecting electrode. The resulting impact of the particles of dust increases the cleaning action, which may also be increased by the use of a correspondingly pulsed high voltage.

Depending on the application the cleaning dust may consist of sand, iron ore, slag, limestone, coal, coke in particle sizes having a median value between, e.g., 80 μm and 300 μm and a specific gravity of greater than 0.9 kg/dm³. It has been founds that owing to the electric adhesive forces the rate at which the cleaning dust is required is almost independent of its specific gravity. The required rate is in the range from 0.1 dm³ to 10 dm³ per hour per linear meter of the length of the collecting electrodes in the direction of flow of the gas. That calculated required rate is not applicable to the last electric field in the direction of gas flow.

Only the length of the collecting electrode region, which is supplied with cleaning dust, is taken into account for that field. The cleaning dust need not be fed continuously at the required rate for the collecting electrodes, but may be fed periodically in time intervals of a few minutes to several hours.

Example: Dedusting of the exhaust gases from an iron ore sintering belt conveyor

| | |
|---|---|
| Rate of exhaust gas | 500,000 sm³/h (sm³ = standard cubic meter) |
| Effective rate of exhaust gas | 800,000 m³/h |
| Dust content of raw gas | 1,000 mg/sm³ |
| Maximum dust content of pure gas | 50 mg/sm³ |
| Rate of dust collection | 475 kg/h |
| Bulk density of dust | 1,000 kg/m³ |
| Data of the selected electrostatic precipitator: | |
| Number of electric fields of force (viewed in the direction of gas flow) | 4 |
| Number of gas passages (parallel) | 30 |
| Height of active field | 12.5 m |
| Length of each field (length of the collecting electrodes arranged in a row in the direction of gas flow) | 4.32 m |
| Distance between gas passages | 0.4 m |
| Distance between corona electrode and collecting electrode | about 0.2 m |
| Total collecting surface areas | 12,960 m² |
| Specific size of deduster (f value) | 58.3 m²/m³/s |
| Velocity of migration (w value) | 5.14 cm/s |
| Deutsch formula | $1 - \eta = e^{-wf}$ |
| Extended Deutsch formula | $1 - \eta = e^{-(wk/f)^k} =$ |

If it is assumed that the gas and dust are uniformly distributed over the cross-section of the electrostatic precipitator, in an ideal case the rate at which dust is collected in the several electric fields or field sections and is transported downwardly can be calculated with the extended Deutsch formula, in which k=0.5 is assumed as a result of experience and measurements. For this reason the rates of collected dust are apparent from the following scheme:

| Height of field | Field 1 | Field 2 | Field 3 | Field 4 | |
|---|---|---|---|---|---|
| 12.5 m | 0 | 0 | 0 | 0 | kg/h |
| 9.375 m | 97 | 13 | 5.75 | 3 | kg/h |
| 6.25 m | 194 | 26 | 11.5 | 6 | kg/h |
| 3.125 m | 291 | 39 | 17.25 | 9 | kg/h |
| 0 m | 388 | 52 | 23 | 12 | kg/h |
| | 475 kg/h = 100% | | | | |

-continued

| Height of field | Field 1 | Field 2 | Field 3 | Field 4 |
|---|---|---|---|---|
| | 81.7% | 10.9% | 4.9% | 2.5% |

It is apparent from that scheme that the degree of separation decreases more than proportionately as the length of the electrostatic precipitator increases. Even if the selective separating action is not taken into account will the rate of dust collected in the outlet part be too low to permit an abrasive action to be produced by rapping so that the collecting electrodes could be kept in a bright metallic state.

Owing to the selective separation of the particle size fraction the dust which enters field 1 still contains a relatively large share of coarse particle sizes. For this reason the addition of the cleaning dust in field 1 may be restricted to 10% of the dust collected in field 1, as is stated in German Patent Specification 861,382, i.e., to 39 kg/h in the numerical example. Conversely, the dust entering field 4 contains only the smallest particles, which can be removed from the collecting electrodes only with great difficulty. It has been found for this reason that cleaning dust must be supplied to that field at a rate which is much higher in relation to the dust to be collected (50% to 200%). In the numerical example a rate of cleaning dust of 100% corresponds to an addition of 12 kg/h. In order to prevent an entraining of cleaning dust by the pure gas which is discharged, cleaning dust is supplied to field 4 only in a length of up to 75% of the length of that field. In the numerical example, fields 2 and 3 are supplied with cleaning dust at rates of 50% and 100%, respectively, of the rate at which fine dust is collected.

For this reason the following values are obtained for a cleaning dust having a bulk density of 1000 kg/m³:

| | | | Field 4 | | |
|---|---|---|---|---|---|
| Field 1 | Field 2 | Field 3 | 75% | 25% | |
| 10 | 50 | 100 | 100 | 0 | |
| 0.29 | 0.19 | 0.17 | 0.12 | 0 | dm³/m h |
| 39 | 26 | 23 | 12 | 0 | kg/h |
| | | 100 kg/h | | | |

If a mean gas velocity of about 1.0 m/s and a velocity of migration of 80 cm/s of the cleaning dust are assumed, the coarse dust which is most remote from the collecting electrode (close to the corona electrode, at a distance of 20 cm) must travel to the collecting electrode over a distance of 25 cm (because 20:80×100=25). The length of field amounts to 4.32 m and the feed rate to 39 kg/h. In the least favorable case (all coarse particles are fed close to the collecting electrode) 2.3 kg/h or 5.8% and than transferred to the next field. This results in the following data:

| | | | | Field 4 | | |
|---|---|---|---|---|---|---|
| | | | | 75% | 25% | |
| Height of field | Field 1 | Field 2 | Field 3 | of the field length | | |
| 12.5 m | 39 | 26 | 23 | 12 | 0 | kg/h |
| | — 2.3 | — 1.5 | — 1.3 | — | 0.7 | kg/h |
| 9.375 m | 133.7 | 39.8 | 28.95 | 14.85 | 1.45 | kg/h |
| 6.25 m | 230.7 | 52.8 | 34.7 | 17.1 | 2.2 | kg/h |
| 3.125 m | 327.7 | 65.8 | 40.45 | 19.35 | 2.95 | kg/h |
| 0 m | 424.7 | 78.8 | 46.2 | 21.6 | 3.7 | kg/h |

-continued

| Height of field | Field 1 | Field 2 | Field 3 | Field 4 | |
|---|---|---|---|---|---|
| | | | | 75% | 25% |
| | | | | of the field length | |
| 575 kg/h | | | | | |

From that Table it is apparent that only 0.7 kg/h coarse dust are entrained from the 75% of the plate length into the last one-fourth of the last field in this example. But an electrode length of 1.08 m is still available for the collection and this ensures that virtually no coarse dust can be entrained by the pure gas which is discharged, in which the coarse dust would add to the dust content. (Although an entraining of 10% or 1.2 kg/h of the cleaning dust supplied to field 4 would increase the dust content of the pure gas only by 2.4 mg/sm$^3$, for instance).

The feeding of cleaning dust to the several fields of force at different rates is accomplished in that the feeding means are operated periodically at different feeding times, different intervals between feedings providing the different feeding rates. The feeding times of the cleaning dust may be synchronized with the rapping of the collecting electrodes in such a manner that the rapping blows and the resulting cleaning will be effected soon after the feeding of the cleaning dust into a given field.

The cleaning dust may consist of dust which has become available in the process and can be recycled to the process. Alternatively, dust from a different source may be used. Alternatively, the coarse-grained cleaning dust may be recovered by sifting the collected dust and may be recycled. Suitable dusts include fine sand, coarse dust from cyclone separators, iron ore, clinker, slag, limestone, coke, coal, e.g., easily flowing coal (low angle of repose of bulk material).

While the invention has been illustrated and described in a process of cleaning a dedusting electrostatic precipitator, it is not intended to be limited to the details shown above, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

We claim:

1. In a process of cleaning a dedusting electrostatic precipitator, said dedusting electrostatic precipitator having a plurality of collecting electrodes on which collecting surfaces are located, being structured so that voltage may be applied to the collecting electrodes and having a gas-flowless space above the collecting electrodes, said process of cleaning comprising the steps of feeding a coarse-grained cleaning dust into the dedusting electrostatic precipitator, collecting at least the coarse-grained cleaning dust electrostatically in the dedusting electrostatic precipitator to form a collected dust and periodically removing the collected dust, the improvement wherein the feeding of the coarse-grained cleaning dust into the electrostatic precipitator occurs so that the coarse-grained cleaning dust is fed only into the gas-flowless space, and further comprising the step of distributing the cleaning dust in and through the gas-flowless space.

2. The improvement as defined in claim 1, further comprising the steps of applying a voltage to the collecting electrodes and periodically decreasing the voltage applied to the collecting electrodes during the step of feeding of the cleaning dust.

3. The improvement as defined in claim 2, wherein said decreasing the voltage applied to the collecting electrodes comprises turning the voltage off.

4. The improvement as defined in claim 1, further comprising arranging the collecting electrodes in a plurality of fields in succession in a direction of gas flow through the dedusting electrostatic precipitator, each of the fields having a length in the direction of gas flow, and wherein said feeding of said coarse-grained cleaning dust includes feeding said coarse-grained cleaning dust at least partially into a downstream-most one of said fields so that said coarse-grained cleaning dust is fed only over 25 to 75% of the length of the downstream-most field.

5. The improvement as defined in claim 1, wherein said feeding of said coarse-grained cleaning dust occurs at a rate of from 0.1 to 10 dm$^3$/h per linear meter of length along the collecting surfaces.

6. The improvement as defined in claim 1, wherein said feeding of the coarse-grained cleaning dust occurs periodically at a plurality of feeding times, and further comprising the steps of providing means for periodically rapping the collecting electrodes, rapping said collecting electrodes by said means for periodically rapping and synchronizing said rapping and said feeding.

7. The improvement as defined in claim 1, wherein the coarse-grained cleaning dust has a median particle size between 80 microns and 300 microns and a specific gravity greater than 0.9 kg/dm$^3$.

8. The improvement as defined in claim 1, further comprising discharging and recovering the collected dust from the dedusting electrostatic precipitator and separating the coarse-grained cleaning dust from the collected dust.

9. The improvement as defined in claim 8, wherein said separating includes sifting said collected dust to separate a fine dust and a residue including the coarse-grained cleaning dust, and then washing and drying the residue to recover the coarse-grained cleaning dust.

10. In an apparatus for cleaning a dedusting electrostatic precipitator, said dedusting electrostatic precipitator comprising a plurality of collecting electrodes arranged in succession in a direction of gas flow in a plurality of fields (14, 15, 16) and having a gas-flowless space above the collecting electrodes, wherein the improvement comprises:

a plurality of downwardly-inclined distributing pipes (1) disposed above the fields (14, 15, 16) for supplying a coarse-grained cleaning dust to the gas-flowless space, said distributing pipes (1) having outlet openings (2) opening into the gas-flowless space, feeding means (18) for supplying the coarse-grained cleaning dust to the distributing pipes;

distributing means (11) connected with said feeding means (18) for conducting said coarse-grained cleaning dust supplied by said feeding means into said downwardly-inclined distributing pipes (1), and a plurality of baffle disks (3) disposed above the fields (14, 15, 16) and below the outlet openings (2) of the distributing pipes for deflecting and distributing said cleaning dust.

11. The improvement as defined in claim 10, further comprising a recycling system (19) for said cleaning dust connected to said distributing means (11) and said feeding means (18), said recycling system (19) including a dust collecting bin (20).

12. The improvement as defined in claim 10, further comprising a top (13) located above the fields (14, 15, 16) and wherein the distributing pipes (1) extend gas-tightly in a downwardly-inclined direction through said top (13) and the distributing means (11) is located above the top (13).

13. In a process of cleaning a dedusting electrostatic precipitator, said electrostatic precipitator having a plurality of collecting electrodes having collecting surfaces and being arranged in a plurality of fields in succession in a direction of flow of a gas through the fields, each of the fields having a length in the direction of gas flow, being structured so that voltage can be applied to the collecting electrodes and having a gas-flowless space above the collecting electrodes; said process of cleaning comprising the steps of feeding a coarse-grained cleaning dust having a median particle size between 80 and 300 microns and a specific gravity greater than 0.9 kg/dm$^3$ into the dedusting electrostatic precipitator, collecting at least the coarse-grained cleaning dust electrostatically in the dedusting electrostatic precipitator to form a collected dust and periodically removing the coarse-grained cleaning dust, the improvement wherein the feeding of the coarse-grained cleaning dust into the electrostatic precipitator occurs so that the coarse-grained cleaning dust is fed only into the gas-flowless space and at a rate of from 0.1 to 10 dm$^3$/h per linear meter of said length over the collecting surfaces, and further comprising the steps of distributing the coarse-grained cleaning dust in the gas-flowless space over the fields, said cleaning dust being introduced during said distributing at least partially in a downstream-most one of said fields and in said downstream-one of said fields only over 25 to 75% of the length of said downstream-most field; and recovering the collected dust and separating the coarse-grained cleaning dust from the collected dust.

14. The improvement as defined in claim 13, further comprising the steps of applying a voltage to the collecting electrodes and periodically decreasing the voltage applied to the collecting electrodes during the step of feeding of the cleaning dust.

15. The improvement as defined in claim 13, wherein said distributing of said cleaning dust includes supplying an upstream-most one of said fields with said coarse-grained cleaning dust at a rate substantially equal to 10% of a collection rate of a fine dust in said upstream-most one of said fields during operation of said electrostatic precipitator.

16. The improvement as defined in claim 13, wherein said distributing of said coarse-grained cleaning dust includes supplying said downstream-most field with said coarse-grained cleaning dust a rate substantially equal to 100% of a collection rate of a fine dust in said downstream-most field.

* * * * *